US005620257A

United States Patent [19]

Hendershot

[11] Patent Number: 5,620,257

[45] Date of Patent: Apr. 15, 1997

[54] HOLDER FOR STORING PAPERS

[76] Inventor: Michael C. Hendershot, 820 Davis St., Suite 220, Evanston, Ill. 60201

[21] Appl. No.: 617,132

[22] Filed: Mar. 18, 1996

[51] Int. Cl.[6] ..... B65D 33/14; B65D 30/22

[52] U.S. Cl. ..... 383/11; 383/22; 383/35; 383/37; 229/72

[58] Field of Search ..... 383/11, 9, 10, 383/17, 22, 25, 35, 37, 38; 229/67.1, 67.2, 68.2, 69, 72

[56] References Cited

U.S. PATENT DOCUMENTS

| | | | |
|---|---|---|---|
| 924,929 | 6/1909 | Pemberton | 229/69 X |
| 1,994,393 | 3/1935 | Hopkins | 229/69 |
| 2,285,447 | 6/1942 | Lichter | 383/9 X |
| 3,360,183 | 12/1967 | Stahl | 383/22 X |
| 4,895,198 | 1/1990 | Samuelson | 383/37 X |
| 5,163,606 | 11/1992 | Isserstedt | 383/37 X |

*Primary Examiner*—Jes F. Pascua
*Attorney, Agent, or Firm*—Paul H. Gallagher

[57] ABSTRACT

A holder made up of a back support and a plurality of pockets. The back support is of single thickness, and the pockets are of double thickness. The back support is of paper but has a cross bar at the top for mounting the device, and the pockets are substantially entirely of paper. The back support and the pockets are secured together by adhesive.

10 Claims, 2 Drawing Sheets

HIGHLY EXAGGERATED

HOLDER FOR STORING PAPERS

SUMMARY OF THE INVENTION

The invention is directed to a device or article for filing or storing papers.

A person encounters many paper items in his daily activities, and the matter of filing them, or putting them away, while they are not having attention, has always been a big problem. This situation exists in the home, for example, as well as in an office. in the home, putting the papers away while they are not being attended to, is basically a secondary step, as compared with an office, where particular attention is usually given to this situation. In various daily activities, a person encounters many paper items, such for example as lists, recipes, manuals, reminders, schedules, bills and orders, etc. Ordinarily, as in the home, such items are very often put in a pile, or in a drawer, many times indiscriminately, and very often it is difficult to locate particular items when it is desired to do so. The situation also often exists in the case of school matters.

The device of the present invention includes a plurality of pockets or individual receptacles, for receiving the various items referred to. A plurality of pockets are provided, one for each classification or group of papers, such as those identified above.

A broad object of the invention is to provide such a device having a plurality of pockets for the papers mentioned, that is very easy to utilize, in putting away the papers, and to locate them according to individual identification, when desired.

Another object is to provide a new and unusual arrangement of pockets that are physically individual, but secured together in an arrangement that is convenient, and logical according to subject matters.

Another object is to provide a device of the foregoing character in which each pocket is constructed as an individual item, the pockets being secured together in a single composite arrangement, to form the desired final device.

A more specific object is to provide a device of the immediately foregoing character, which because of its plurality of pockets, it is of modular character, that is, the pockets are individual but can be secured together, and in so securing them together, they become a part of a single mechanical or physical structure, all of the pockets working together to form that structure.

Another object is to provide such an article in the use of which, in placing the papers therein, the papers are arranged in an easily observable arrangement or pattern, and, for removal, can be easily selected individually.

Still another object is to provide an article of the foregoing character, that is non-bulky, and is of relatively flat shape, even with the papers put away therein, and accordingly occupies a minimum of space.

BRIEF DESCRIPTION OF THE INDIVIDUAL FIGURES OF THE DRAWINGS

DETAILED DESCRIPTION OF THE DRAWINGS

Figure 2:
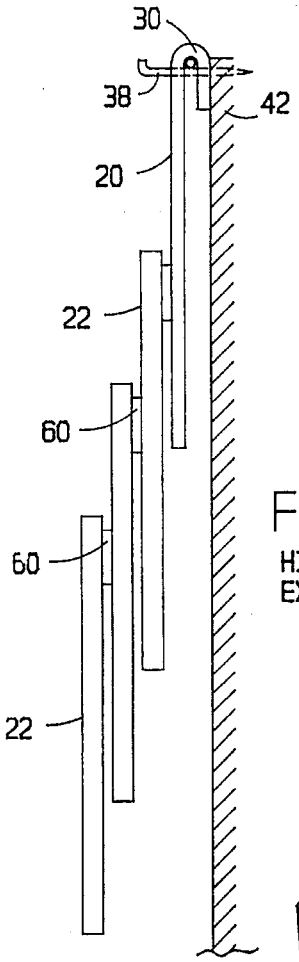
FIG. 2 is an edge view taken at line 2—2 of FIG. 1.
Figure 1:
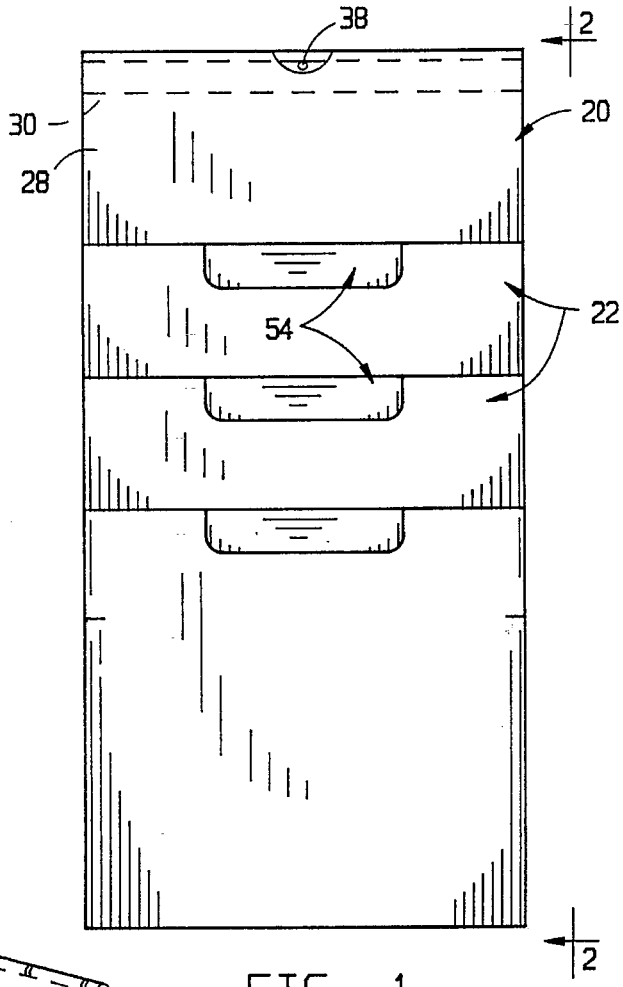
FIG. 1 is a face view of the device made according to the invention.
Figure 3:
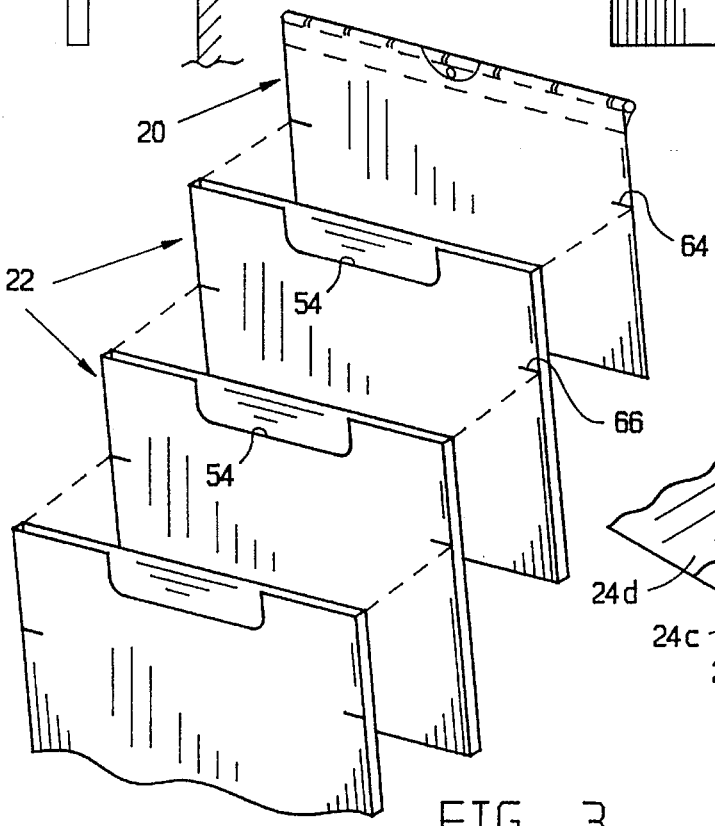
FIG. 3 is an exploded perspective view of the device.

The entire article, the device of the invention, is shown generally, or in its entirety, in FIGS. 1–3. For convenience it is referred to as being constituted by a back support 20 and a plurality of pockets 22. The back support and pockets may be referred to generically as components.

For ease in description, and identifying the parts making up the device, it is stated that the entire device is made up almost entirely of paper. Exceptions exist in the inclusion of a mounting bar for holding the device, and release strips and adhesive for mounting each component on the previous one.

Detail reference is made to the material from which the components are made. This material preferably used herein and referred to above as "paper", is paper in the broad definition of that word, but preferably it is of what is known as non-woven. Such material distinguishes from ordinary paper which is made up of pulp cells of generally roundish shape; instead in the present case, it is made up of spun material, in the form of filaments or strings which are thin and elongated, secured together. In certain cases, at least, it may be of polypropylene. The material is made up of a plurality of layers stacked one upon another, and in successive layers, the filaments lie in different directions, all serving to support filaments in other layers, and those in each layer working toward separation of filaments in other layers. The result is an extremely strong material. The layers are individually extremely thin, and so thin that even several layers plied together result in still an extremely thin final sheet of paper. The material may also be referred to as paper-like. A material known as TYVEK put out by DuPont is suitable for the purpose.

Figure 4:
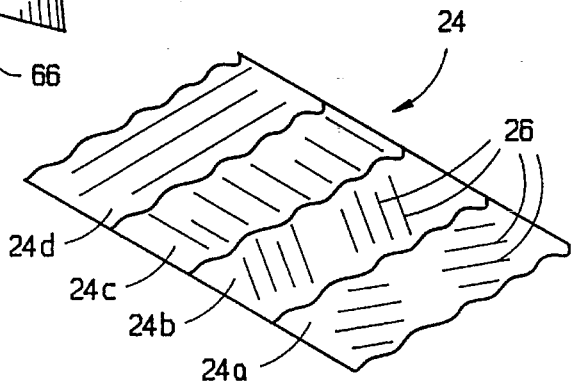
FIG. 4 is a break-away view of paper of a kind used in the device.

Such a sheet of material is represented in FIG. 4, identified 24 made up of layers 24*a*, 24*b*, 24*c*, 24*d*. The filaments referred to are indicated at 26, and it will be seen that these filaments in successive layers lie in different directions.

Figure 6:
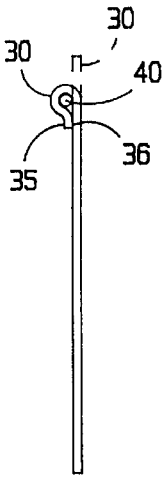
FIG. 6 is an edge view taken at line 6—6 of FIG. 5 but with the top flap folded down.
Figure 5:
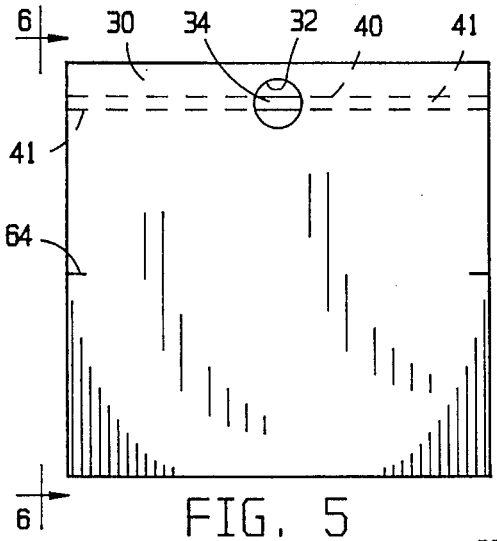
FIG. 5 is a front view of the top element of the device, but with the top flap in folded out position.

For convenience the device is identified or oriented in vertical position. The back support 20 is made up basically of a single sheet 28, which is provided with a flap 30 (FIGS. 1, 5, 6). The sheet has a hole 32 near the top, and a bar 34 is fitted across the top of the sheet on the back side, and across the hole, and the flap 30 is folded down (FIGS. 1, 6) and secured to the back of the sheet at 35, preferably by an adhesive located at 36.

After the flap is folded down (FIG. 1) the upper and lower portions of the hole 32 are in register, forming a hole through the panel for receiving a hook 38 (FIGS. 1, 2) for hanging the device. The hole is at the center, transversely, for balancing the entire device on the hook, in pendulum fashion.

Preferably the bar 40 is of metal, for strength, providing the desired support entirely across the article. It is however within the scope of the invention that this element may be of other form. It is also within the scope of the invention that a magnet may be used instead of, or with, the bar for holding the device up on a metallic appliance, etc. Such a magnetic element, or elements, are indicated at 41 in FIG. 5.

While dimensions of the back support 20 may be as desired, a convenient size is for example 10" wide, 8–10" in vertical direction, or depth.

In use, the device is mounted as represented in FIG. 2, wherein the hook 38 is mounted in the wall 42, the sheet 28 hanging down against the wall. A pocket 22 is secured thereto, in a manner referred to below, and then other pockets are secured successively to the previous pockets in a manner represented in FIG. 2. These pockets may be in any desired number, within reasonable limits, for providing space for holding the ultimate groups of papers to be accommodated. It will be noted that the back support is basically of a single thickness, while the pockets are nearly entirely of double thickness.

Figure 7:
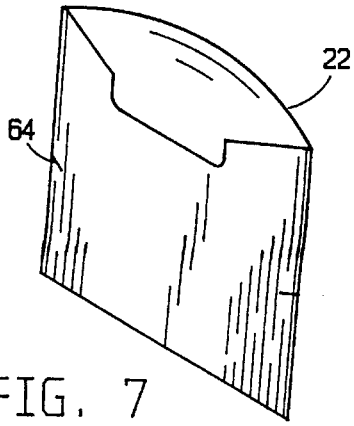
FIG. 7 is a perspective view of one or the pockets in open position.
Figure 8:
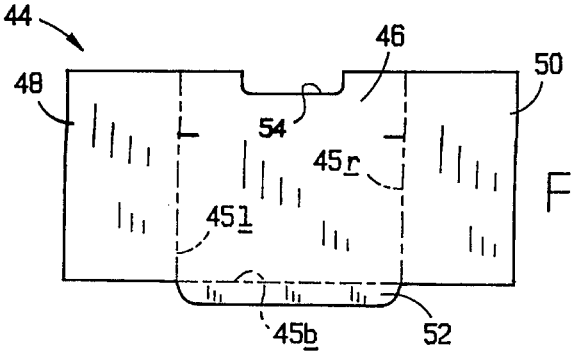
FIG. 8 is face view of a flat blank from which a pocket is formed.

Reference is now made to the specific construction of an individual pocket 22. FIG. 7 shows in perspective the final formed pocket. It is made from a single blank 44 (FIGS. 8, 9) which is shown in FIG. 8 as a flattened out single sheet. This sheet is shown with score lines 45, including individual ones, 45*l*, 45*r*, 45*b*, for left, right, bottom respectively. These score lines define a central section 46, a left section 48, a right section 50 and a bottom tab 52. In the top edge of the central section 46 is a notch 54 for forming a grab notch in the completed item.

Figure 10:
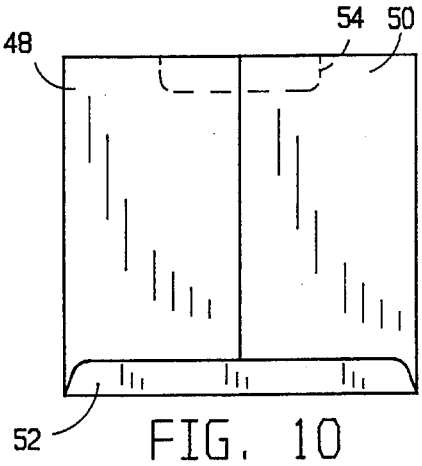
FIG. 10 is a rear view of the pocket after it is folded, in a step following that of FIG. 9.
Figure 9:
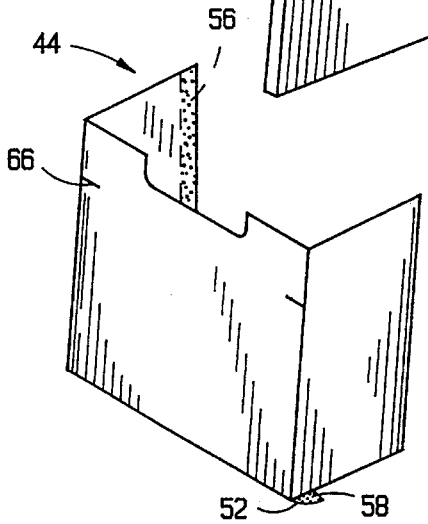
FIG. 9 is a perspective view of the blank of FIG. 8 in a semi-folded condition.

The side sections 48, 50 are folded across the back of the central section 46, on the score lines, and their free edges are overlapped (FIG. 10) and secured together by an adhesive material 56 (FIG. 9). The bottom flap 52 is provided with adhesive material at 58, and this flap is folded up over the folded side sections (FIG. 10). The notch 54 (FIG. 8) in the blank, now is shown (FIG. 10) in the finalized pocket. Preferably the adhesive used is what is known as hot melt.

Thus each pocket is of essentially double thickness, it being understood that at the seams and overlaps there will be another thickness. The pocket 22 will of course be thus thicker than the back support 20, but the difference is not great, and from a practical standpoint in sensing the various components in handling the device, this thickness may not be apparent. At the grab notch 54 the pocket will be only of single sheet thickness.

Figure 11:
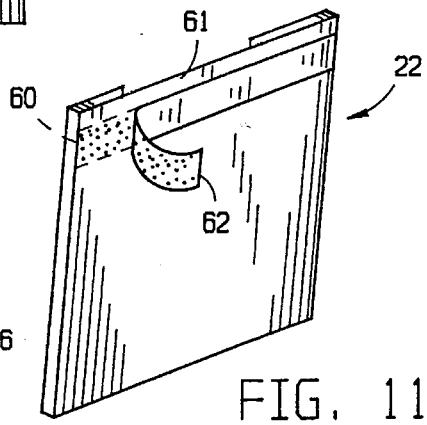
FIG. 11 is a perspective view of the rear side of a pocket showing a release liner and adhesive thereon.

In mounting the pockets on the back support, this is done preferably by an adhesive material. Each pocket is provided with a strip of adhesive material 60 (FIG. 11) adjacent to the top thereof and extending entirely across the pocket. This strip may however if desired be spaced from the top edge of the pocket a minor extent, as indicated at 61.

A release liner 62 of the size and shape of the line of adhesive is provided and fitted over the adhesive, in the manufacture of the pocket. The pocket is mounted on the back support by means of this adhesive, and in doing so, the usual step is taken, of removing the release liner and pressing the pocket on the back support. The vertical location of the pocket on the back support, as indicated above, may be as desired, and to conserve space it is preferably located adjacent the top of the back support. However for convenience, it may be spaced downwardly from the top edge of the back support, and for convenience in so locating the pocket, the back support may be provided with indicator lines 64 (FIG. 3), at which the upper edge of the pocket is positioned.

As many pockets may be incorporated in the device as desired, according to the number of groups or classifications of the items to be accommodated. Thus a second pocket is secured to the first pocket in the same manner as described above in fitting the first pocket to the back holder. Also preferably each pocket on the front side is provided with indicator markers 66 (FIGS. 3 and 9) similar to the markers 64 and similarly located, so that each successive pocket may be mounted on the previous pocket at that location. In the case of a plurality of pockets, the vertical spacing between successive pockets, is more significant, as will be understood in observing FIGS. 1 and 3. The grab notches 54 will be successively spaced, thus avoiding accidental insertion of the fingers in a wrong pocket. The device may also be referred to as modular.

The strength of the non-woven material, or paper, making up the article is of extreme importance in considering the distribution of forces in the use of the finished article. The back support is supported entirely across its top dimension by the bar 40, and thus all increments of it in transverse direction are supported evenly, with extended support transmitted vertically through the entire material of the component. A similar situation exists in the case of the pockets considered successively. Each pocket is supported firmly across its width, adjacent its top edge, and this support in a similar manner is transmitted vertically in all increments, transversely of the paper, down through the entire extension of the next pocket. This support continues from each pocket to the next.

Consequently, the firm and strong support given at the top of the completed device is transmitted vertically throughout the entire device, through all of the components. The entire device is unitary and effectively integral.

The non-woven material, or paper, identified above, does not tear easily, and even if a small tear should accidentally be started in an edge of the paper, the tear does not continue easily, as an extension of a first tear, but additional great force must be applied to overcome the resistance to tearing. Accordingly the material is very effective for holding the intending contents.

As indicated above, the device is particularly effective in the case of the home, and for the student. In retaining items of this nature, they are generally of paper themselves, that is, flat sheets, and they fit in the pockets conveniently. Each pocket will hold quite a number of papers, which may result in a relatively great thickness, but this total thickness usually does not amount to an annoying extent. Accordingly the entire device, with a great number of items therein, will still be an overall relatively flat device, and it can be placed, as by hanging, in a relatively small space, so that it will not be annoying to a person in other normal movements of the latter.

Figure 12:
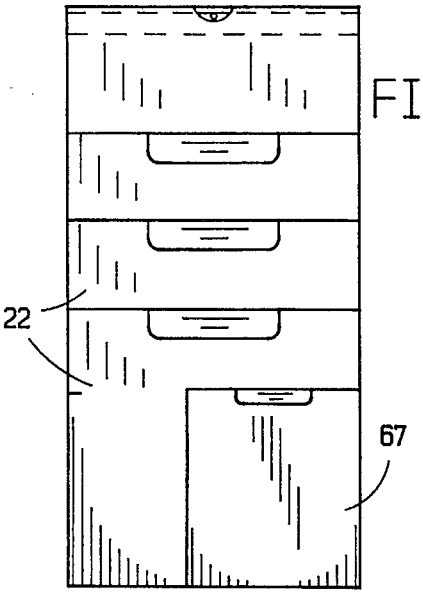
FIG. 12 is a face view similar to FIG. 1, on a reduced scale, showing a slightly modified form of device.

While the pockets 22 may be all of the same dimension, and particularly in width, it is not essential that they be so dimensioned. FIG. 12 shows an article made up according to the above, with a plurality of pockets 22 of identical size, but with an additional pocket 67 secured to the lowermost large pocket 22. While it may be desired to use pockets all of the same size for strength purposes, or for convenience, the invention is of such scope as to cover smaller pockets. Normally the smaller pockets may be placed at the bottom, so as not to interfere with full opening of a later applied large pocket.

I claim:

1. A holder for holding flat papers identified as having a vertical position, comprising, a plurality of components which include a back support and at least one pocket, the back support being in the form of a flat panel and having a seam along its top edge, and a rigid bar in the seam extending essentially the width of the panel, and further having an aperture through the seam at the center, transversely, exposing the bar and receiving a hook for holding the panel, each pocket being in the form of a double flat panel forming a closed bottom and an open top and having a width substantially the same as that of the back support, the back support, except for said bar, and each pocket being made up of paper, and means securing the pocket to the back support along a transverse line extending the width of the pocket at the top of the latter, and, when the pocket is secured to the back support, spaced downwardly from the top of the back support.

2. A holder according to claim 1 wherein, the securing means is adhesive means.

3. A holder according to claim 1 wherein, the back support is a single-thickness sheet.

4. A holder according to claim 1 wherein, each pocket is made up of a single sheet folded at spaced vertical lines forming a full width front section and side sections having their free edges secured together in a vertical seam, the front section having a bottom flap folded up and secured to the side sections at the rear, the vertical lines of folding forming continuous side edges of the completed pocket.

5. A holder according to claim 1 wherein, the holder includes a plurality of pockets, and each component includes indicator markers on its front surface indicating a transverse line below its top edge for each successive component applied to a previous component.

6. A holder according to claim 1 wherein, the material of which the components are made is non-woven paper.

7. A holder according to claim 1 and including, means for detachably mounting the holder on a mounting member that includes magnets.

8. A holder according to claim 1 wherein, the components are all of the same width, and the lines of securement between adjacent components extending throughout the width of the components.

9. A holder according to claim 1 wherein, the pockets are of different sizes.

10. A holder according to claim 1 wherein, the pockets include grabber notches in the upper edges of their front elements.

* * * * *